US009340992B2

(12) United States Patent
Huang

(10) Patent No.: US 9,340,992 B2
(45) Date of Patent: May 17, 2016

(54) COLLAPSIBLE MECHANISM AT THE TOP OF A COLLAPSIBLE TENT

(71) Applicant: Xiamen RoadzUp Outdoor Products Co.,ltd, Xiamen (CN)

(72) Inventor: Changjiu Huang, Xiamen (CN)

(73) Assignee: Xiamen Roadzup Outdoor Products Co., Ltd., Xiamen (CN)

( * ) Notice: Subject to any disclaimer, the term of this patent is extended or adjusted under 35 U.S.C. 154(b) by 29 days.

(21) Appl. No.: 14/157,996

(22) Filed: Jan. 17, 2014

(65) Prior Publication Data

US 2014/0338710 A1 Nov. 20, 2014

(30) Foreign Application Priority Data

May 17, 2013 (CN) ..... 2013 1 0186509

(51) Int. Cl.
*E04H 15/32* (2006.01)
*E04H 15/48* (2006.01)
*E04H 15/42* (2006.01)

(52) U.S. Cl.
CPC ..... *E04H 15/32* (2013.01); *E04H 15/42* (2013.01); *E04H 15/48* (2013.01)

(58) Field of Classification Search
CPC ..... E04H 15/42; E04H 15/44; E04H 15/48; E04H 15/322
See application file for complete search history.

(56) References Cited

U.S. PATENT DOCUMENTS

| | | | | | |
|---|---|---|---|---|---|
| 1,853,367 | A * | 4/1932 | Mace | 135/123 |
| 2,976,876 | A * | 3/1961 | Lonnqvist | 135/124 |
| 5,284,172 | A * | 2/1994 | Teate, Jr. | 135/27 |
| 6,899,112 | B2 * | 5/2005 | Tsai | 135/131 |
| 7,509,967 | B2 * | 3/2009 | Kim | 135/135 |
| 7,607,447 | B1 * | 10/2009 | Han | 135/135 |
| 7,861,736 | B2 * | 1/2011 | Choi | 135/143 |
| 8,047,218 | B1 * | 11/2011 | Shin | 135/135 |
| 8,360,085 | B2 * | 1/2013 | Lee | 135/135 |
| 8,485,208 | B2 * | 7/2013 | Seo | 135/135 |
| 2014/0238456 | A1 * | 8/2014 | Jin | 135/147 |

FOREIGN PATENT DOCUMENTS

CN 0222066.5 5/2003

* cited by examiner

*Primary Examiner* — David R Dunn
*Assistant Examiner* — Danielle Jackson
(74) *Attorney, Agent, or Firm* — Wang Law Firm, Inc.

(57) ABSTRACT

The present invention is provided with a collapsible mechanism at the top of a collapsible tent, which comprises a top base and at least two sets of supporting pole sets. The top base comprises an upper pivot base, a lower pivot base and a vertical pole to fix the upper pivot base and the lower pivot base; at least two sets of supporting pole sets are connected to the top base and arranged annularly; each of the supporting pole set comprises a sub-pole, a connecting base and a supporting pole, a first end of the sub-pole is pivot joint with the lower pivot base, a second end of the sub-pole is pivot joint with the supporting pole, the connecting base is pivot joint with the upper pivot base, the connecting base is slidably connected to the sub-pole and form a flexible structure.

8 Claims, 8 Drawing Sheets

COLLAPSIBLE MECHANISM AT THE TOP OF A COLLAPSIBLE TENT

FIELD OF THE INVENTION

The present invention relates to a collapsible mechanism at the top of a collapsible tent.

BACKGROUND OF THE INVENTION

Conventional collapsible mechanism at the top of a collapsible tent, for example disclosed are in the Chinese patent database with patent number ZL02220066.5, in the American patent database with U.S. Pat. No. 7,861,736, U.S. Pat. No. 7,607,447 and U.S. Pat. No. 8,047,218. The conventional mechanism generally comprises a central base, a lower pivot base, a sub-pole, a supporting pole and a spring. The central base comprises a vertical pole and an upper pivot base fixed to the upper end of the vertical pole, the lower pivot base is slidably connected to the vertical pole; the spring is sleeved on the vertical pole and abuts against between the upper pivot base and the lower pivot base; the lower end of the sub-pole is pivot joint with the lower pivot base, the upper end of the sub-pole is pivot joint with the supporting pole, the upper end of the supporting pole is pivot joint with the upper pivot base. When it is collapsed, one structure is that the lower pivot base slides upwards; another structure is that the lower pivot base slides downwards. Therefore, the collapsible mechanism has disadvantages as below: the vertical pole has to be long enough to make sure that the sub-pole and the supporting pole are folded in parallel when it is collapsed, thus reducing inner space of the tent, and the appearance of the tent is not attractive.

SUMMARY OF THE INVENTION

The present invention discloses a collapsible mechanism at the top of a collapsible tent, which overcomes the disadvantages of the conventional technology of the collapsible mechanism at the top of a collapsible tent.

The technical proposal of the present invention is as below:

A collapsible mechanism at the top of a collapsible tent, comprising:

a top base, comprising an upper pivot base; a lower pivot base; and a vertical pole fixed with the upper pivot base and the lower pivot base; and at least two sets of supporting pole sets, which are connected to the top base and arranged annularly; each of the supporting pole set comprising a sub-pole; a connecting base; and a supporting pole wherein, a first end of the sub-pole is pivot joint with the lower pivot base, a second end of the sub-pole is pivot joint with the supporting pole, the connecting base is pivot joint with the upper pivot base, the connecting base is slidably connected to the sub-pole and form a flexible structure.

In another preferred embodiment, a spring is disposed between the connecting base and the supporting pole.

In another preferred embodiment, a lock mechanism is disposed between the connecting base and the supporting pole.

In another preferred embodiment, the supporting pole is a pipe; the connecting base comprises an upper connecting element and a fixed pole, a first end of the upper connecting element is pivot joint with the upper pivot base, the end face of a second end of the upper connecting element is concave and form a sliding groove, the fixed pole is assembled to the upper connecting element and disposed inside the sliding groove, a part of the fixed pole extends out of the opening of the sliding groove; the fixed pole is slidably connected inside the supporting pole, the supporting pole is slidably connected inside the sliding groove, the spring is disposed inside the supporting pole, sleeved outside of the fixed pole and connected to the fixed pole and the supporting pole.

In another preferred embodiment an end of the supporting pole is fixed with a first plug, the first plug is disposed inside the sliding groove; an end of the fixed pole is disposed with a second plug, which is fit and slidably connected inside the supporting pole; the spring abuts against between the first plug and the second plug.

In another preferred embodiment, the upper connecting element is substantially the shape of Arabic numeral 7, it has a straight section and a bending section fixed to the straight section, an end of the bending section is the first end of the upper connecting element, an end of the straight section is the second end of the upper connecting element.

In another preferred embodiment, the upper connecting element is substantially the shape of Arabic numeral 7, it has a straight section and a bending section fixed to the straight section, an end of the bending section is the first end of the upper connecting element, an end of the straight section is the second end of the upper connecting element; the central of the bottom surface of the sliding groove is concave and form a through hole;

the fixed pole extends into the sliding groove along the through hole from outside to inside, the second plug, is fixed to the end of the fixed pole, the fixed pole and the supporting pole are applied with a pull force by the spring and move away from each other by the pull force, the fixed pole and the upper connecting element are fixed by the pull force.

In another preferred embodiment, the supporting pole is fixed with a rotation base; the second end of the sub-pole is pivot joint with the rotation base.

In another preferred embodiment, the number of the supporting pole sets is two, three, four, five, six, seven or eight.

Compared to the conventional technology, the technical proposal of the present invention has advantages as below:

1. On one hand, with the flexible structure of connecting base and the supporting pole, it is cooperated with the sub-pole and the top base, therefore it is capable of realizing a flexible supporting structure; on the other hand, the upper pivot base and the lower pivot base of the top base are fixed, the top base is short in height, and the top of the tent is short in height, thus its appearance is more attractive and enlarging the inner space of the tent.

2. A spring is disposed between the connecting base and the supporting pole, thus realizing automatically unfolded and folded.

3. A fixed pole is slidably connected inside the supporting pole, the supporting pole is slidably connected inside the sliding groove, the spring is disposed inside the supporting pole, sleeved outside of the fixed pole and connected to the fixed pole and the supporting pole, thus its appearance is more attractive and enhancing the strength of the tent.

4. The upper connecting element is substantially a shape of Arabic numeral 7 and it has a straight section and a bending section fixed to the straight section, an end of the bending section is the first end of the upper connecting element, an end of the straight section is the second end of the connecting element, the collapsible mechanism at the top can be completely collapsed, therefore occupying less space after collapsed than the conventional tent.

5. the fixed pole is capable of extending into the sliding groove along the through hole from outside to inside, the second plug is fixed to the end of the fixed pole, the fixed pole and the supporting pole are applied with a pull force by the spring and pulled to be away from each other, the fixed pole and the upper connecting element are fixed by the pull force, thus it is convenient to be assembled and with a reliable structure.

BRIEF DESCRIPTION OF THE DRAWINGS

The present invention is further described with the drawings and the embodiments.

DETAILED DESCRIPTION OF THE EMBODIMENTS

Figure 1:
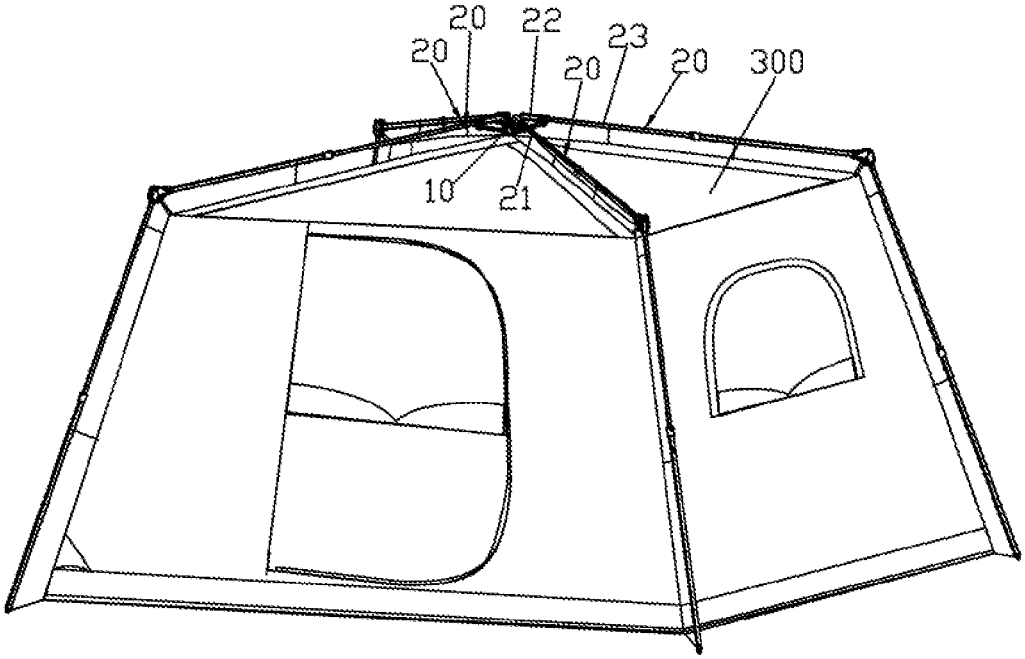
FIG. 1 illustrates a schematic diagram of a tent.
Figure 2:
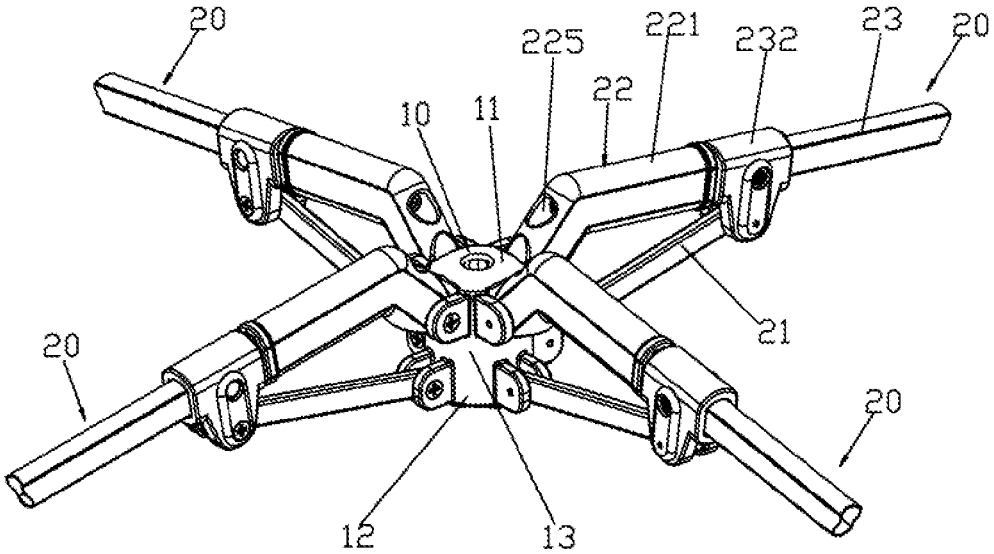
FIG. 2 illustrates a schematic diagram of the collapsible mechanism of a first embodiment when it is unfolded.
Figure 3:
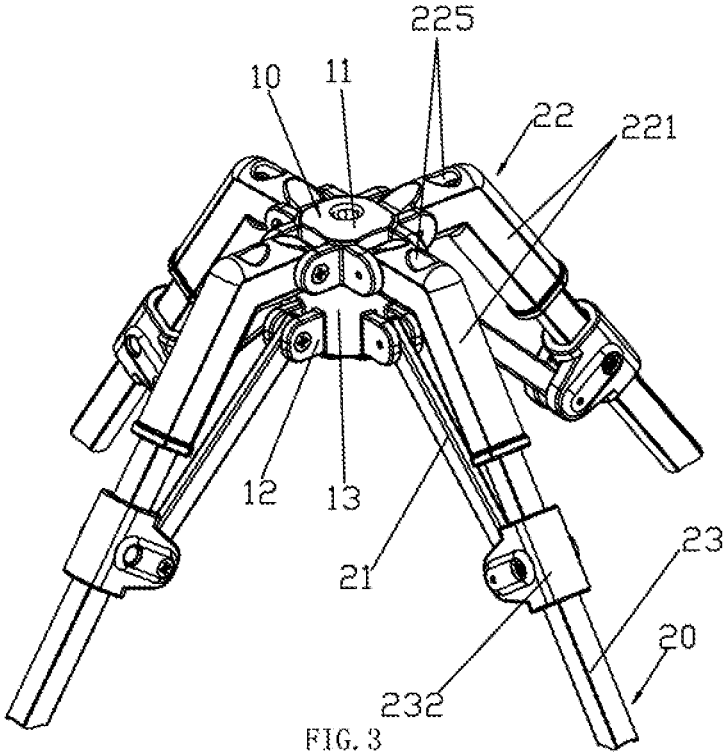
FIG. 3 illustrates a schematic diagram of the collapsible mechanism of a first embodiment when it is half collapsed.
Figure 4:
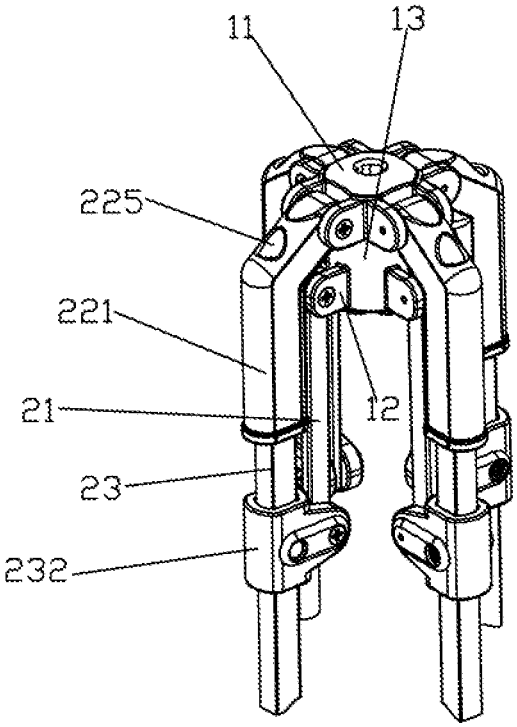
FIG. 4 illustrates a schematic diagram of the collapsible mechanism of a first embodiment when it is totally collapsed.
Figure 5:
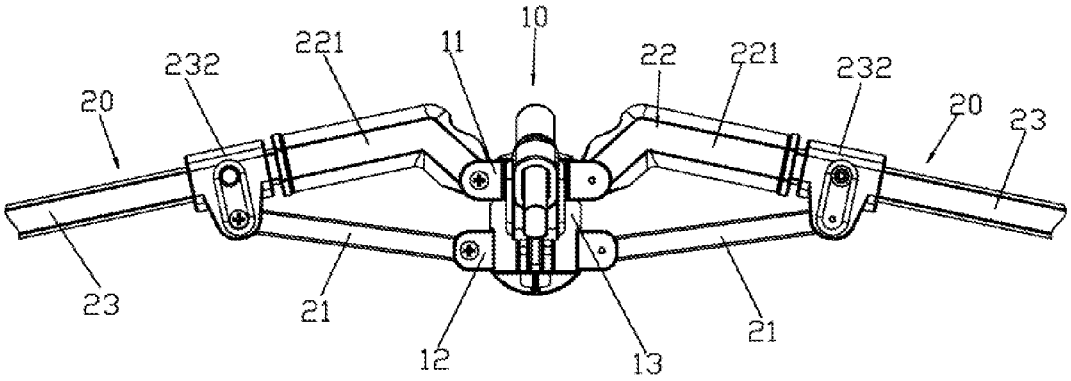
FIG. 5 illustrates a front view of the collapsible mechanism of a first embodiment when it is unfolded.
Figure 6:
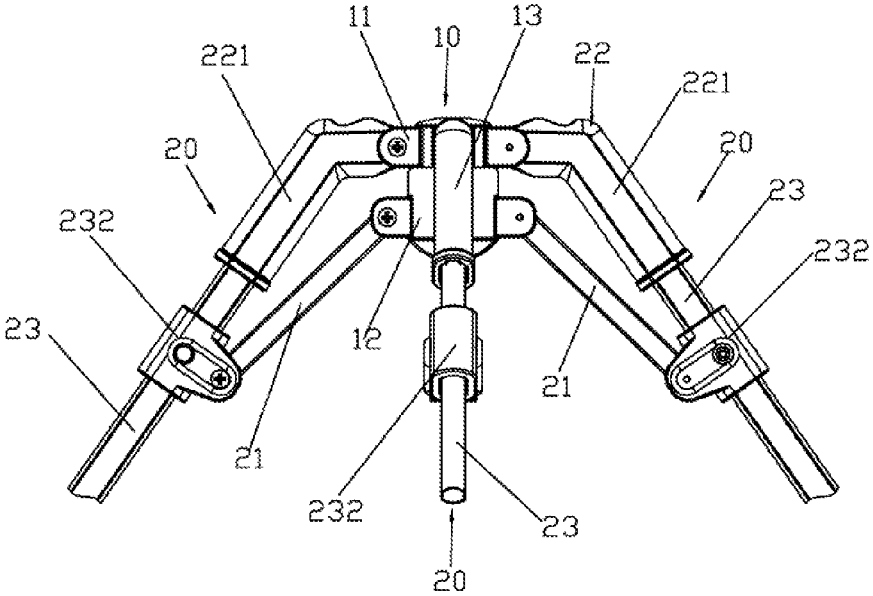
FIG. 6 illustrates a front view of the collapsible mechanism of a first embodiment when it is half collapsed.
Figure 7:
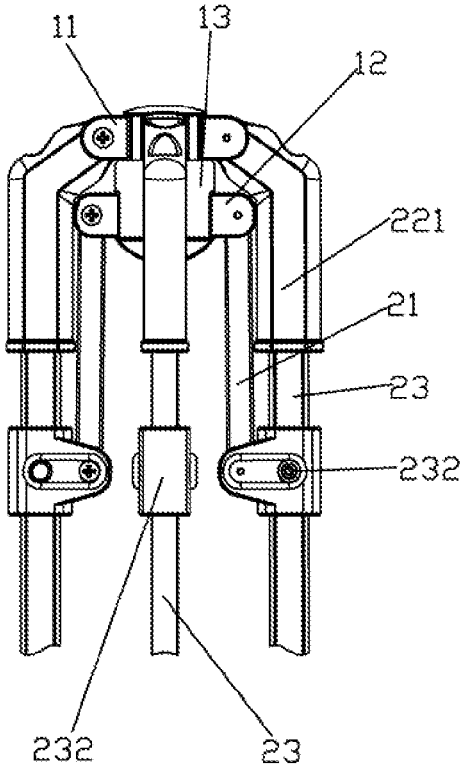
FIG. 7 illustrates a front view of the collapsible mechanism of a first embodiment when it is totally collapsed.
Figure 8:
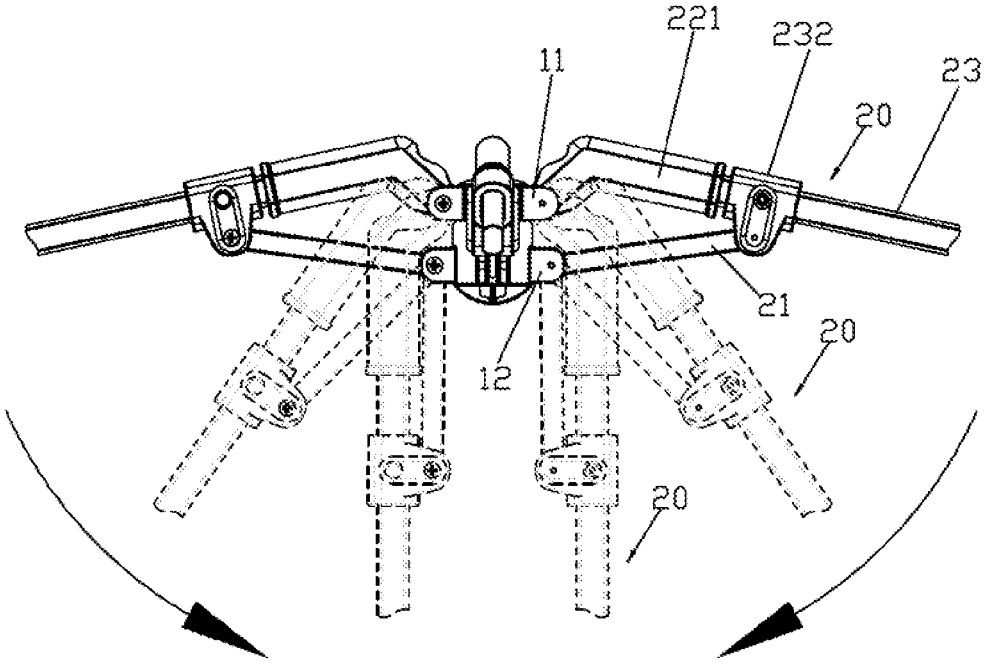
FIG. 8 illustrates a front view of the collapsing of the collapsible mechanism of a first embodiment.
Figure 9:
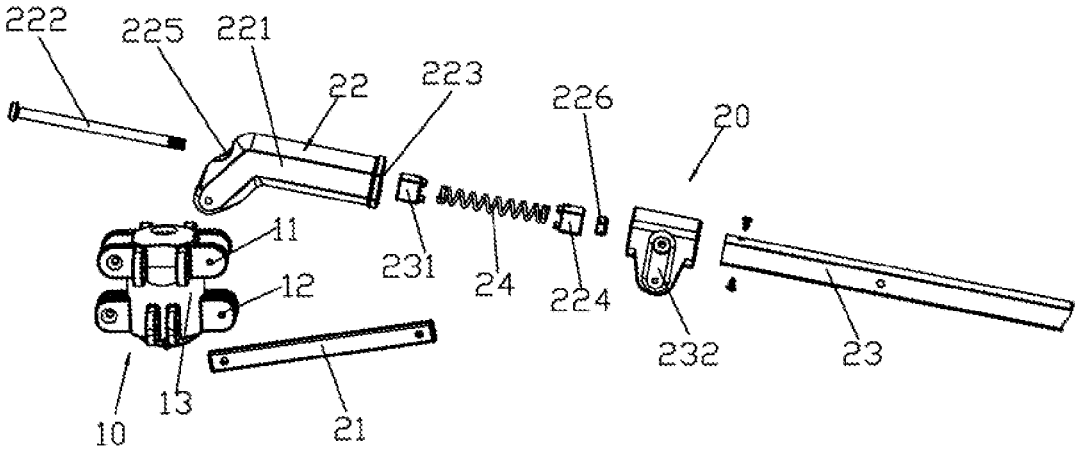
FIG. 9 illustrates a schematic and exploded diagram of the top base and one supporting pole set of the collapsible mechanism of a first embodiment.
Figure 10:
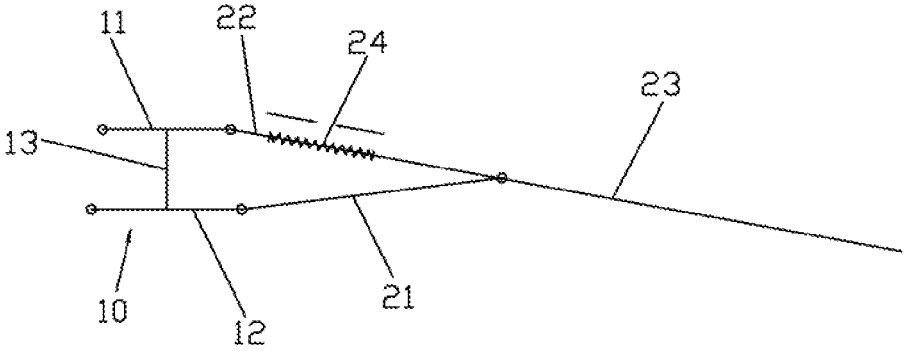
FIG. 10 illustrates the working principle of the top base and one supporting pole set of the top collapsible mechanism of a first embodiment.
Figure 11:
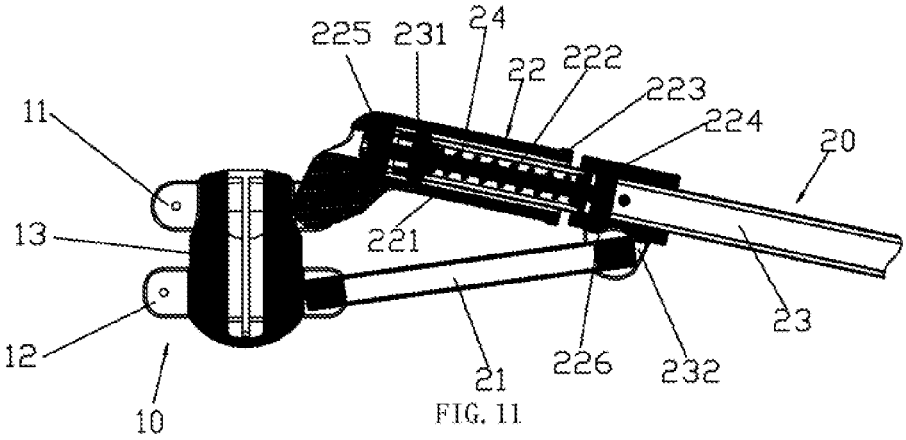
FIG. 11 illustrates a sectional view of the top base and one supporting pole set of the collapsible mechanism when it is unfolded of a first embodiment.
Figure 12:
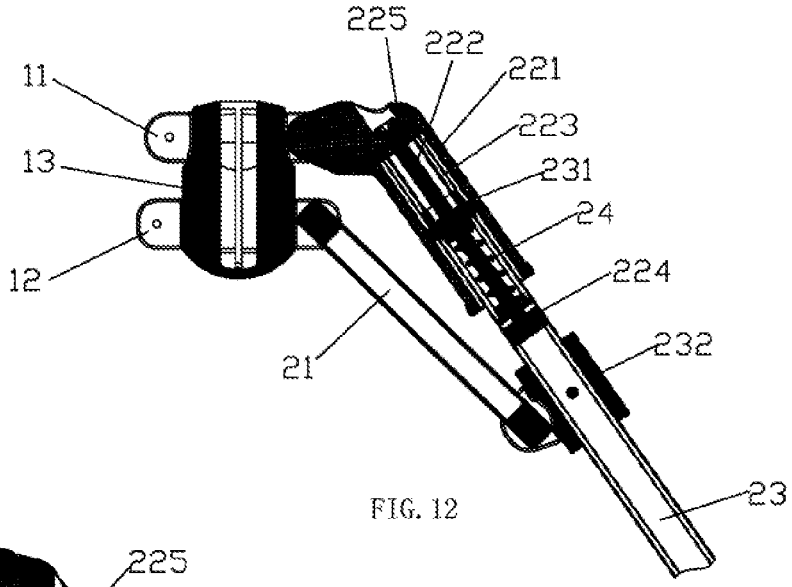
FIG. 12 illustrates a sectional view of the top base and one supporting pole set of the collapsible mechanism when it is half collapsed of a first embodiment.
Figure 13:
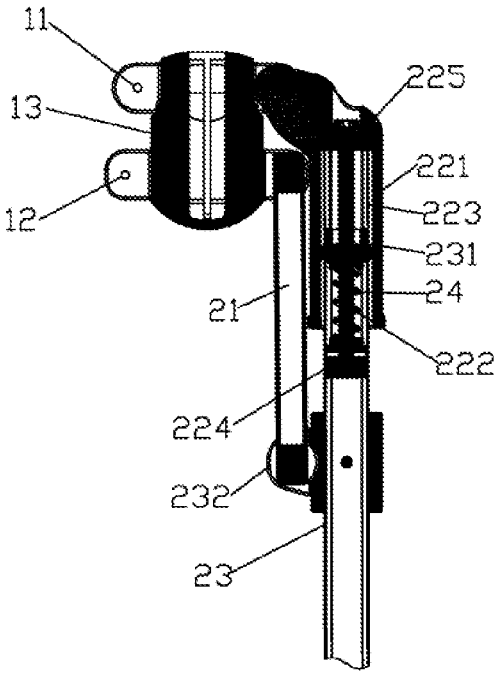
FIG. 13 illustrates a sectional view of the top base and one supporting pole set of the collapsible mechanism when it is totally collapsed of a first embodiment.

Please refer to FIG. 1 to FIG. 13, a collapsible mechanism at the top of a collapsible tent of a first embodiment comprises top base 10 and four sets of supporting pole sets 20, four sets of supporting pole sets 20 are connected to top base 10 and are arranged annularly, in this embodiment, it takes four sets as an example, but not limited to this, it can be applied with two, three, five, six, seven or eight sets as needed. Tarpaulin 300 is disposed under the sub-pole and the top base.

Top base 10 comprises upper pivot base 11, lower pivot base 12 and vertical pole 13 fixed with upper pivot base 11 and lower pivot base 12. Upper pivot base 11 comprises an upper central portion and four upper lug sets, the four upper lug sets are convex and annularly disposed at the periphery of the upper central portion, each of the upper lug set comprises two spaced upper lugs; lower pivot base 12 comprises a lower central portion and four lower lug sets, the four lower lug sets are convex and annularly disposed at the periphery of the lower central portion, each of the lower lug set comprises two spaced lower lugs; two ends of vertical pole 13 are respectively fixed with the centers of the upper central portion and the lower central portion, so as to connect the upper central portion and the lower central portion together.

Each of supporting pole set 20 comprises sub-pole 21, connecting base 22, supporting pole 23 and spring 24. The first end of sub-pole 21 is disposed between the two lower lugs and pivot joint with the two lower lugs by a pivot shaft, thus making the first end of sub-pole 21 pivot joint with lower pivot base 12. The second end of sub-pole 21 is pivot joint with supporting pole 23, for example, the structure can be as below: supporting pole 23 is fixed with rotation base 232; the second end of sub-pole 21 is pivot joint with rotation base 232.

Connecting base 22 comprises upper connecting element 221 and fixed pole 222, upper connecting element 221 is substantially the shape of Arabic numeral 7 and it has a straight section and a bending section fixed to the straight section, the end of the bending section is the first end of upper connecting element 221, the end of the straight section is the second end of upper connecting element 221. The first end of upper connecting element 221 is pivot joint with upper pivot base 11; an example of the structure is that: the first end of upper connecting element 221 is disposed between the two upper lugs and is pivot joint with the upper lugs by a pivot shaft. The end face of the second end of upper connecting element 221 is concave and form sliding groove 223, the central of the bottom surface of sliding groove 223 is concaved and from through hole 225. Fixed pole 222 is a screw, which is disposed with a threaded section; fixed pole 222 extends in to sliding groove 223 along through hole 225 from outside to inside, thus making that: the screw head of the screw leans on the read portion of the straight section, fixed pole 222 is assembled with upper connecting element 221 and disposed inside sliding groove 223, part of fixed pole 222 extends out of the opening of sliding groove 223 to cooperate with the spring so that the fixed pole is applied with a pull force, the pull force makes the screw head is supported and leans on the rear portion of the straight section, so as to fix the fixed pole and upper connecting element 221.

Connecting base 22 is slidably connected to supporting pole 23 to form a flexible structure. An example of the structure is: supporting pole 23 is a pipe; the end of supporting pole 23 is fixed with first plug 231, first plug 231 is assembled inside the supporting pole and is fixed by a screw; the end of fixed pole 22 is disposed with second plug 224, second plug 224 is sleeved outside of fixed pole 222, further nut 226 is screwed on the threaded section of fixed pole 222 to limit second plug 224 from separating outward, second plug 224 abuts against the nut by the spring for being fixed, second plug 224 is fit and slidably connected inside supporting pole 23 supporting pole, thus fixed pole 222 is capable of being slidably connected inside supporting pole 23 and reducing fiction.

Spring 24 is disposed inside sub-pole 23, sleeved outside of fixed pole 222 and is abuts against between first plug 231 and second plug 224.

Please refer to FIG. 2 to FIG. 4, FIG. 5 to FIG. 7 and FIG. 11 to FIG. 12, when the tent is totally collapsed, supporting pole sets 20 rotate inward with respect to top base 10, connecting base 22 and sub-pole 23 extend oppositely sub-pole, spring 24 is compressed to store energy, the supporting pole, the sub-pole and the vertical pole are folded in parallel, thus occupying less space than the conventional tent. The operation of unfolding tent is opposite to the operation of collapsing tent.

In a second embodiment, the difference from the first embodiment is that there is no spring; a lock mechanism is disposed between connecting base 22 and supporting pole 23 instead.

In a third embodiment, the difference from the first embodiment is that the fixed pole extends out of the through hole from inside to outside, the second plug is sleeved outside of the fixed pole, the second plug is fixed by a screw head and a spring, the nut is locked to the fixed pole and is supported on the outside of the upper connecting element.

Figure 14:
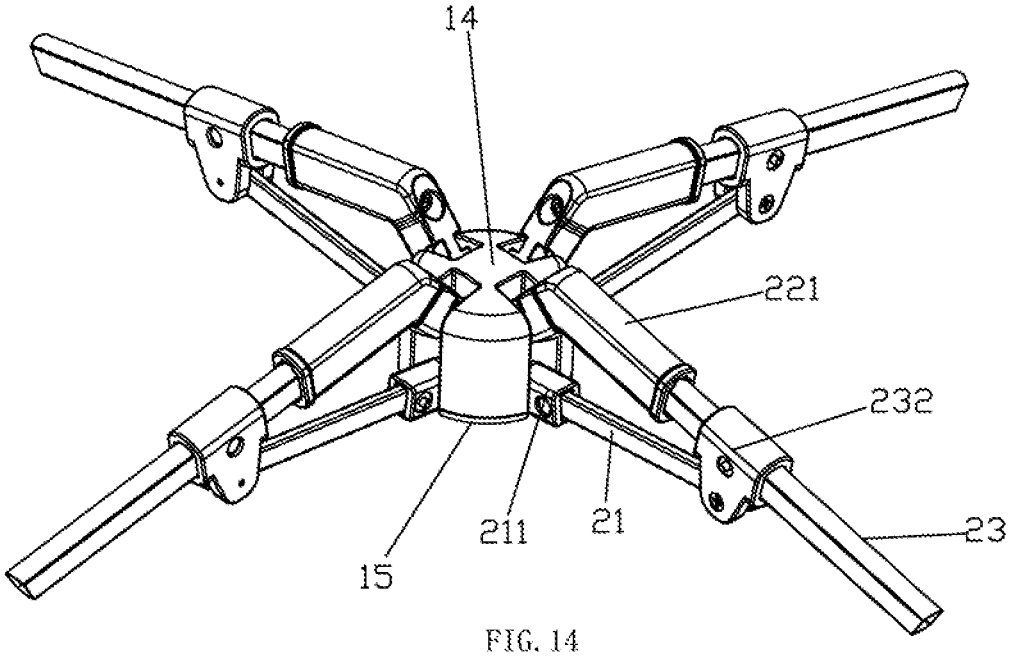
FIG. 14 illustrates a schematic diagram of the collapsible mechanism of a fourth embodiment when it is unfolded.
Figure 15:
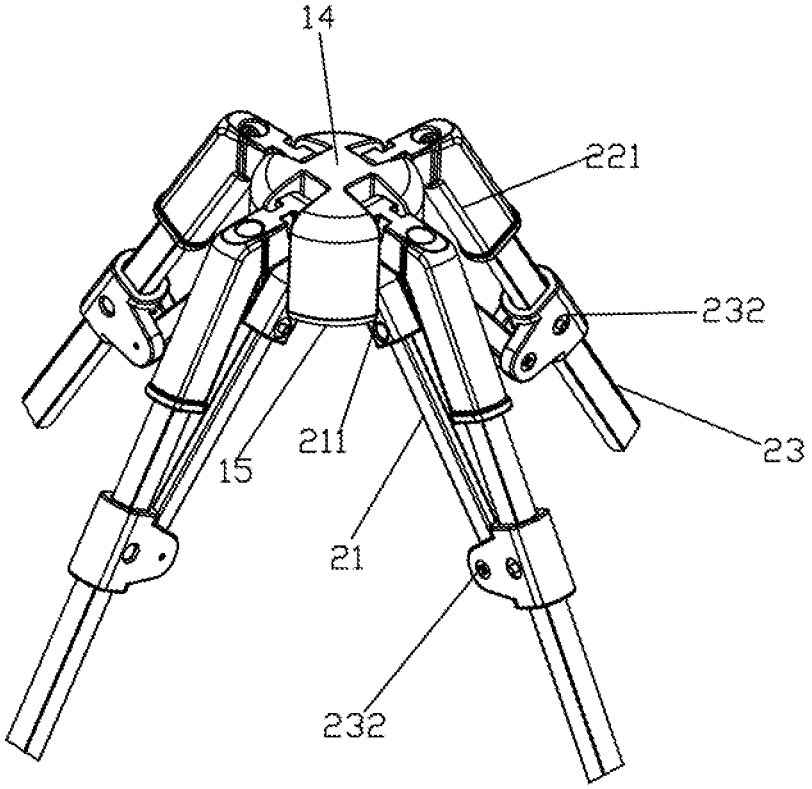
FIG. 15 illustrates a schematic diagram of the collapsible mechanism of a fourth embodiment when it is half collapsed.
Figure 16:
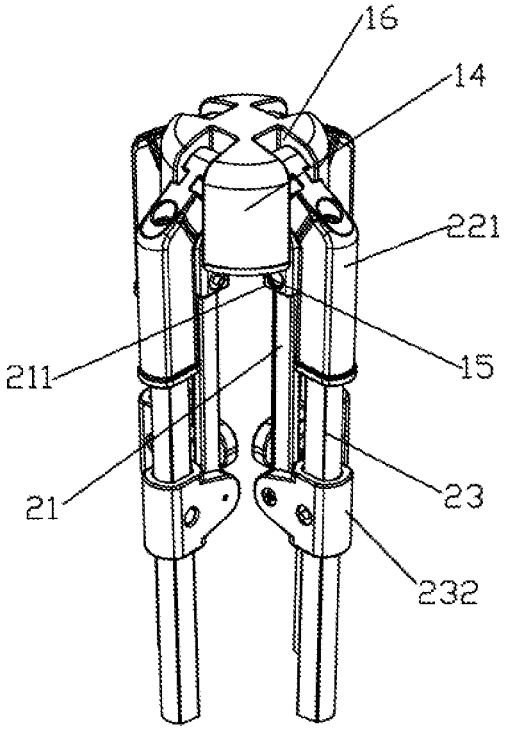
FIG. 16 illustrates a schematic diagram of the collapsible mechanism of a fourth embodiment when it is collapsed.
Figure 17:
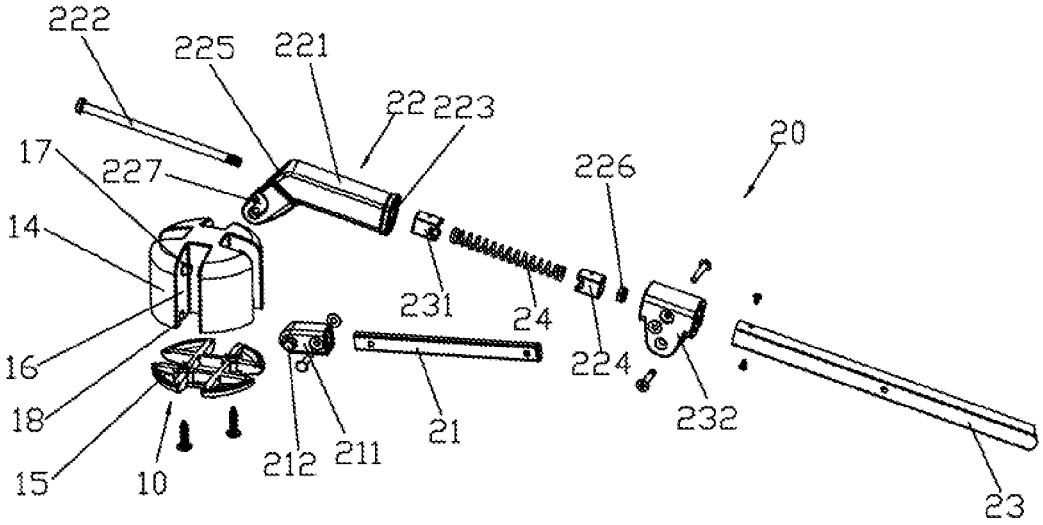
FIG. 17 illustrates a schematic and exploded diagram of the collapsible mechanism of a fourth embodiment.

In a fourth embodiment, please refer to FIG. 14 to FIG. 17, the difference from the first embodiment is as below:

Top base 10 comprises connecting upper base 14 and connecting lower base 15; connecting upper base 14 is fixed to connecting lower base 15, the periphery surface of connecting upper base 14 and connecting lower base 15 are concaved and disposed with several corresponding upper through grooves and lower through grooves, the upper through grooves and the lower through grooves of connecting upper base 14 and the connecting lower base 15 are fit to form pivot grooves 16. Pivot shaft 17 is convex on the groove surface of pivot groove 16 in the connecting upper base 14; a first pivot hole 18 is disposed in the pivot groove 16 in the cooperating portion of connecting upper base 14 and connecting lower base 15; thereinto, the upper portion of pivot groove 16 and pivot shaft 17 form upper pivot base 11 in the first embodiment, the lower portion of pivot groove 16 and first pivot hole 18 form lower pivot base 12 of the first embodiment, the portion of connecting upper base 14 between pivot shaft 17 and the pivot hole is formed to be vertical pole 13 above mentioned. Preferred, the connecting upper base and the connecting lower base are housing shaped, so that the connecting upper base and connecting lower base are fixed to make the pivot hole with small-opening-large-inside shaped.

The end of sub-pole 21 is fixed with assembly base 211, the top end of assembly base 211 is fixed with pivot joint 212, pivot joint 212 is pivot joint with the pivot hole; in this embodiment, making pivot joint 212 positioned to the connecting upper base and the connecting lower base, and then assembling the connecting upper base and the connecting lower base, pivot joint 212 is fit to the pivot hole and connecting together.

A side wall of the bending section of upper connecting element 221 is concave and form L-shaped groove 227, which has an open groove and an internal groove connected to the open groove, the groove surface of the internal groove is concave with a second pivot hole, the pivot shaft is fit and inserted into the pivot hole through the L-shaped groove by elastic deformation.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

I claim:

1. A collapsible mechanism at the top of a collapsible tent comprising:

a top base comprising an upper pivot base;

a lower pivot base; and a vertical pole attached to the upper pivot base and the lower pivot base; and at least two sets of supporting pole sets, each supporting pole set connected to the top base and extending radially away from the top base, each of the supporting pole set comprising a sub-pole having a first end and a second end;

a connecting base; and a supporting pole, wherein the first end of the sub-pole is pivotally attached to the lower pivot base, the second end of the sub-pole is pivotally attached to the supporting pole, the connecting base is pivotally attached to the upper pivot base, the connecting base is slidably connected to the sub-pole and forms a flexible structure, and the upper pivot base and the lower pivot base of the top base are fixedly connected to each other.

2. The collapsible mechanism at the top of a collapsible tent according to claim 1, wherein a spring is disposed between the connecting base and the supporting pole.

3. The collapsible mechanism at the top of a collapsible tent according to claim 2, wherein the supporting pole is a pipe; the connecting base comprises an upper connecting element and a fixed pole, a first end of the upper connecting element is pivotally attached to the upper pivot base, an end face of a second end of the upper connecting element is concave and form a sliding groove, the fixed pole is assembled to the upper connecting element and disposed inside the sliding groove, a part of the fixed pole extends out of an opening of the sliding groove; the fixed pole is slidably connected inside the supporting pole, the supporting pole is slidably connected inside the sliding groove, the spring is disposed inside the supporting pole, sleeved outside of the fixed pole and connected to the fixed pole and the supporting pole.

4. The collapsible mechanism at the top of a collapsible tent according to claim 3, wherein an end of the supporting pole is fixed with a first plug, the first plug is disposed inside the sliding groove; an end of the fixed pole is disposed with a second plug, which is fit and slidably connected inside the supporting pole; the spring abuts against the first plug and the second plug.

5. The collapsible mechanism at the top of a collapsible tent according to claim 4, wherein:

the upper connecting element has a shape generally resembling Arabic numeral 7, the upper connecting element has a straight section and a bending section connected to the straight section, an end of the bending section is the first end of the upper connecting element, an end of the straight section is the second end of the upper connecting element: a portion of the first end of the upper connecting element is concave and forms a through hole;

the fixed pole extends into the sliding groove along the through hole from outside to inside, the second plug is fixed to the end of the fixed pole, the fixed pole and the supporting pole are applied with a pull force by the spring and move away from each other by the pull force, the fixed pole and the upper connecting element are fixed by the pull force.

6. The collapsible mechanism at the top of a collapsible tent according to claim 3, wherein the upper connecting has a shape generally resembling Arabic numeral 7, the upper connecting element has a straight section and a bending section fixed to the straight section, an end of the bending section is the first end of the upper connecting element, an end of the straight section is the second end of the upper connecting element.

7. The collapsible mechanism at the top of a collapsible tent according to claim 1, wherein the supporting pole is fixed with a rotation base, and the second end of the sub-pole is pivot joint with the rotation base.

8. The collapsible mechanism at the top of a collapsible tent according to claim 1, wherein the number of the supporting pole set is two, three, four, five, six, seven or eight.

* * * * *